United States Patent [19]

Senn

[11] 4,155,378

[45] May 22, 1979

[54] METHOD FOR DRIVING SHUTTLES OF A WAVE-SHED MACHINE, AND WAVE-SHED LOOM FOR CARRYING OUT THE METHOD

[75] Inventor: Georg Senn, Tann-Rüti, Switzerland

[73] Assignee: Rüti Machinery Works Ltd, Rüti, Switzerland

[21] Appl. No.: 851,194

[22] Filed: Nov. 14, 1977

[30] Foreign Application Priority Data

Nov. 30, 1976 [CH] Switzerland ..... 15037/76

[51] Int. Cl.[2] ..... D03J 1/00

[52] U.S. Cl. ..... 139/1 R; 139/45; 139/429; 139/436; 139/196.3

[58] Field of Search ..... 139/1 R, 45, 116, 429, 139/436, 196.3; 184/14, 15 R

[56] References Cited

U.S. PATENT DOCUMENTS

| | | | |
|---|---|---|---|
| 1,019,032 | 3/1912 | Farmer | 139/45 |
| 3,900,050 | 8/1975 | Strauss | 139/436 |
| 3,996,973 | 12/1976 | Strauss et al. | 139/436 |
| 4,046,224 | 9/1977 | Smutny | 139/45 |

*Primary Examiner*—Henry Jaudon
*Attorney, Agent, or Firm*—Donald D. Denton

[57] ABSTRACT

A method of driving shuttles through sheds formed by warp yarns of a wave-type loom in which a transport edge of the shuttles is lubricated before entrance into the warp yarns, and a wave-shed loom for carrying out the method of driving the shuttles.

7 Claims, 4 Drawing Figures

METHOD FOR DRIVING SHUTTLES OF A WAVE-SHED MACHINE, AND WAVE-SHED LOOM FOR CARRYING OUT THE METHOD

BACKGROUND OF THE INVENTION

The present invention relates to a method for driving the shuttles of a wave-shed loom by reed blades which, during operation, in their entirety press against the transport edge of the shuttles and carry out a ripple or undulating movement in a direction advancing over the width of the loom.

In known wave-shed looms, in which the shuttles are driven by means of swingable reed blades, relatively high frictional forces occur between the transport edge of the shuttles and the reed blades. This leads, on the one hand, to the transport edges of the plastic shuttles becoming so greatly worn that they show sawtooth-like scorings after a relatively short period of operation, as a result of which the shuttles become unusable. On the other hand, the high frictional forces can have the result that in those types of machines in which the shuttles are not guided during their insertion movement by a special guide comb but merely by the warp yarns, the shuttles assume an oblique position and emerge upward or downward out of the warp yarns.

SUMMARY OF THE INVENTION

The object of the present invention eliminates these disadvantages and is achieved in the manner that the transport edge of each shuttle is acted on by a lubricant before its entrance into the warp yarns.

Practical tests have shown that the aforementioned disadvantages are completely avoided by the process of the invention and that, with suitable application of the lubricant, the soiling of the warp yarns with lubricant, which may at first blush be feared by the man skilled in the art, does not occur.

The invention furthermore relates to a wave-shed loom for the carrying out of said process having reed blades which extend at the place where the web is formed, between the warp yarns, and which are arranged alongside of each other along an axis of swing over the weaving width of the loom.

The wave-shed loom of the invention is characterized by a lubricating member, arranged in the region alongside the warp threads, connected to a lubricant reservoir and providing lubrication to the transport edge of the shuttles during operation.

BRIEF DESCRIPTION OF THE DRAWINGS

The invention will be explained in further detail with reference to an illustrative embodiment and the figures of the drawing, in which.

DESCRIPTION OF PREFERRED EMBODIMENT

Figure 1:
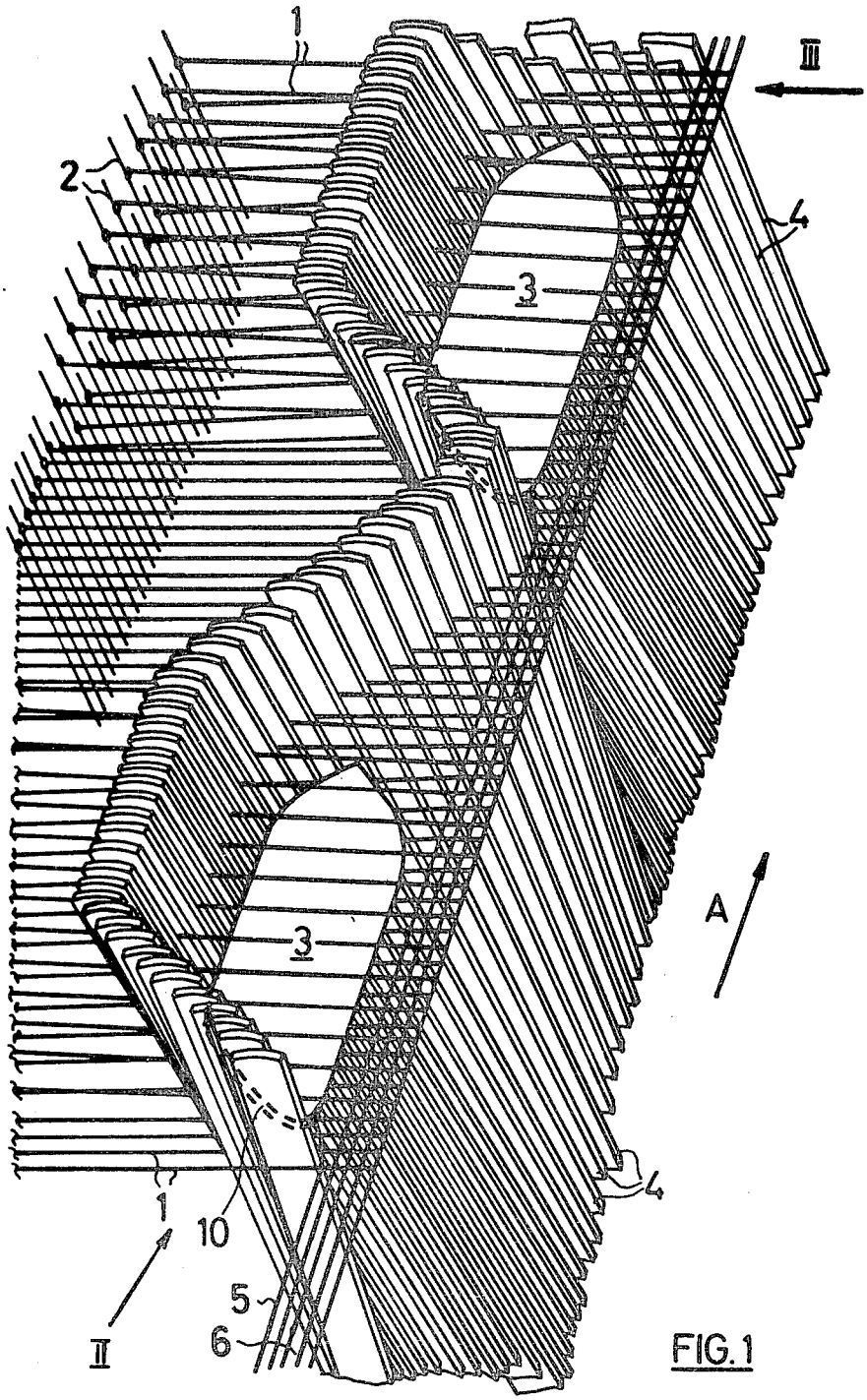
FIG. 1 is a view in perspective showing diagrammatically a portion of a wave-shed loom with shuttles and the reed blades driving them.

Referring to FIG. 1, warp yarns 1, which are moved by heddles 2 and extend towards the fell of the cloth, form an open shed at the place of the front part of each shuttle 3. Between every two successive shuttles 3 a change of shed takes place. The sheds propagate themselves in ripple shape in the direction indicated by the arrow A; the shuttles 3 move together with the sheds in the same direction and during their transport insert one filling yarn 5 each. The warp yarns 1, for clarity in the drawing, have been shown less close together than is actually the case. The cloth formed by the insertion of the filling yarns 5 is designated by 6.

The forward movement of the shuttles 3 is effected by reed blades 4 which act as shuttle drive and filling-yarn beating-up members and extend between the warp yarns 1 and are pressed from the rear against the rear beveled edge 10 of the shuttles 3 (as seen in the direction of transport) and thereby move the shuttles in the direction indicated by the arrow A. At the same time, the corresponding filling yarns 5 are beaten-up against the fell of the cloth by those reed blades 4 which are swung furthest forward. The guiding of the shuttles 3 in the corresponding shed is effected by the warp yarns 1.

Figure 2:
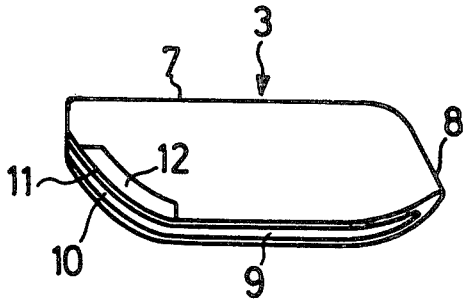
FIG. 2 is a view in perspective of a shuttle, seen in the direction of the arrow II in FIG. 1.

As shown in FIG. 2, the shuttles 3 are of elongated, flat, U-shape and consist essentially of two side walls connected with each other along the upper edge 7 of the shuttle and the greatest part of the tip 8 of the shuttle. At the lower edge 9 and at the rear beveled edge 10 the two side walls are not connected with each other. As a result of the U-shape of the shuttles 3, only the arm of the U-shaped rear beveled edge 10 of the shuttle 3 which is at the bottom in FIG. 1 and facing the viewer in FIG. 2 is in contact with the reed blades 4 upon the transportation of the shuttle. This part of the rear oblique edge 10 of the shuttles 3 is referred to hereinafter as the transport edge 11 of the shuttles 3.

Within the shuttles 3 there is maintained, in operation, a yarn package consisting of adjacent loops which has a length sufficient for the required weaving width, the holding of the yarn package being effected exclusively by the inner surfaces of the side walls of the shuttles 3 and by elastic inserts mounted on said inner surfaces. Upon the transport of the shuttles 3 through the sheds, the filling yarn 5 (as can be noted from FIG. 1) is pulled continuously obliquely forward out of the shuttle 3 at the rear oblique edge 10.

The shuttles 3 consist of a suitable plastic, for example polyacetal, and are provided at their transport edge 11 with a reinforcing runner 12 in the form of a small thin plate. The reinforcing runner 12 serves to reduce the wearing down of the transport edge 11 by the reed blades 4 (FIG. 1) and consists of a sufficiently hard material of a hardness corresponding approximately to that of spring steel. Of the metallic materials entering into consideration for the reinforcing runner, a heat-treated beryllium bronze alloy of a hardness of 42 Rockwell has proven particularly suitable.

Figure 3:
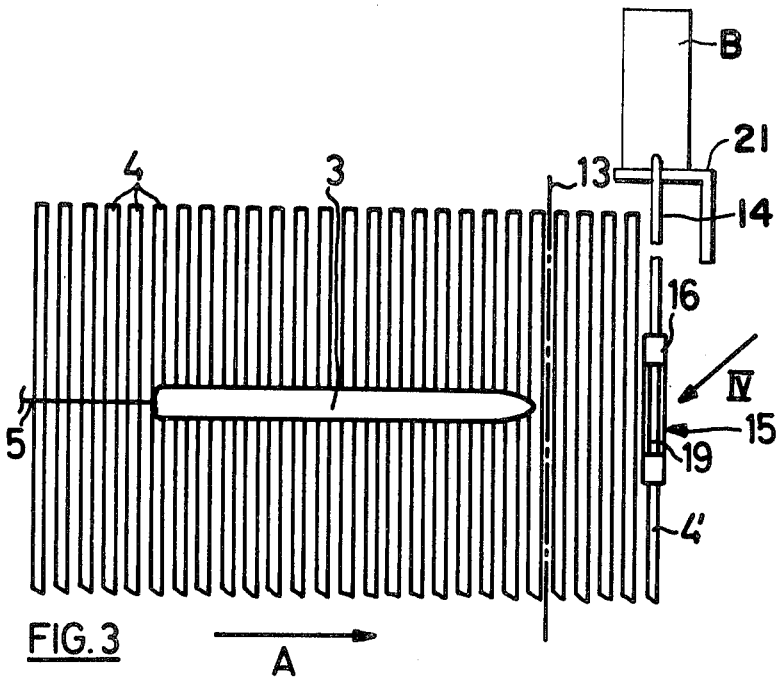
FIG. 3 is a corresponding top view of the reed blades in the region of selvage at the outlet side of the shuttle, seen in the direction indicated by the arrow III in FIG. 1.
Figure 4:
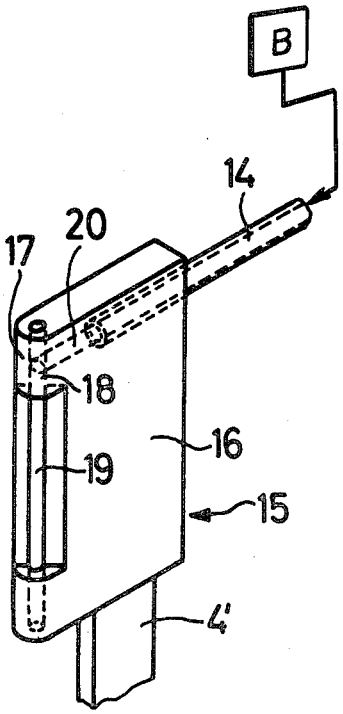
FIG. 4 is a view in perspective, seen in the direction of the arrow IV in FIG. 3, represented on a larger scale.

In accordance with FIGS. 3 and 4, within the region of the selvage (indicated by a dot-dash line 13) on the outlet side of the shuttle 3 from the group of warp yarns, there is provided a lubricating member or means 15 which is connected via a small hose 14 to a reservoir B containing liquid lubricant, for instance polyethylene glycol. The lubricant reservoir B is mounted on a member 21 which member is fastened to the machine frame. The lubricating member 15 feeds lubricant from reservoir B and serves to provide the transport edge 11 of the shuttles 3 with lubricant after the emergence of the shuttles from the warp yarns 1 (FIG. 1) and thereby reduce the friction between the transport edge 11 and the reed blades 4 by presenting a film of lubricant over the reinforcement runner 12 so that upon the following insertion of the shuttle, the transport edge 11 will not become worn. The oil is applied as a thin film to the reinforcement runner 12 (FIG. 2) so that it remains in adherence to the latter in an amount sufficient for the desired lubricating action without there resulting any recognizable soiling of the warp yarns. In the case of shuttles 3 which are made of polyacetal, the reinforcing runner 12 has proven particularly advantageous with respect to the lubrication since polyacetal is a material which cannot be wetted, or only wetted with difficulty, and accordingly the application of a suitable film of lubricant would involve at least great difficulties.

The lubricating member 15, as shown in the drawing, is formed by the outermost reed blade 4' at the outlet side of the shuttle. This reed blade 4' whose length is reduced as compared with that of the other reed blades 4 bears a prismatic lubricating part 16 at its front end. The lubricating part 16 is provided in the region of the front surface 17, viewed from the cloth 6 (FIG. 1) in the longitudinal direction of the reed blade 4', with a first borehole 18 in which a lubricating wick 19 is held. The front surface 17 is so beveled up to near its upper and lower ends that the borehole 18 containing the lubricating wick 19 is partially exposed. The length of the shortened reed blade 4', the dimensions of the lubricating part 16, as well as the bevel of the front surface 17 are so designed that the lubricating wick 19 lies in the path of movement of the transport edge 11 and faces the latter. The lubricating part 16 is furthermore provided with a borehole 20 which extends perpendicular to the first borehole 18 and discharges into same, the hole 14 connected to the reservoir discharging into said borehole 20.

It will be appreciated that it is not absolutely necessary for the lubricating member 15 to be arranged on the outlet side of the shuttle; the lubricating member 15 of course may be mounted outside the group of warp yarns on the shuttle entrance side.

It will also be appreciated that various changes and/or modifications may be made within the skill of the art without departing from the spirit and scope of the invention illustrated, described, and claimed herein.

What is claimed is:

1. A method of driving shuttles through sheds formed by warp yarns of a wave-shed loom by means of reed blades which, in operation, in their entirety carry out an undulating movement in direction advancing over the width of the loom and press against a transport edge of the shuttles, comprising providing the shuttles in the region of the transport edge with a reinforcing runner of hard material and applying to the reinforcing runner of each shuttle a lubricant before its entrance into the warp yarns.

2. The method according to claim 1 in which the reinforcing runner is formed from a material having a hardness corresponding approximately to the hardness of spring steel.

3. The method according to claim 2 in which the reinforcing runner is a heat-treated beryllium-bronze alloy.

4. A wave-shed loom arrangement for driving shuttles through sheds formed by warp yarns by means of reed blades which in their entirety carry out an undulating movement, said reed blades extending, at the place of the formation of the shed, between the warp yarns and arranged alongside of each other along an axis of swing above the weaving width of the loom, characterized by shuttles being provided in the region of the transport edge with a reinforcing runner of hard material and by a lubricating means arranged in the region near the group of warp yarns, operatively connected to a lubricant reservoir for providing lubricant to said reinforcing runner of the shuttles during operation.

5. The wave-shed loom arrangement according to claim 4 in which the lubricating means is formed on a shortened reed blade and has a lubricating part mounted on the free end of said blade.

6. The wave-shed loom arrangement according to claim 5 in which the lubricating part is of prismatic shape having a lubricating wick on the front surface thereof which faces the transport edge of the shuttles.

7. The wave-shed loom arrangement according to claim 6 in which the lubricating wick is held in a first borehole extending in the longitudinal direction of the shortened reed blade and partially exposed by a beveling of the front surface, and the lubricating part is provided with a second borehole which extends perpendicular to the first borehole and discharges into it, into which second borehole a small hose connected to the lubricant reservoir discharges.

* * * * *